US007464907B1

(12) United States Patent
Lane

(10) Patent No.: US 7,464,907 B1
(45) Date of Patent: Dec. 16, 2008

(54) BRACKET ASSEMBLY TO SUSPEND OBJECTS

(76) Inventor: Terry Lane, 18335 Collins Ave., Apt. 112, North Miami Beach, FL (US) 33160

( * ) Notice: Subject to any disclaimer, the term of this patent is extended or adjusted under 35 U.S.C. 154(b) by 0 days.

(21) Appl. No.: 11/869,060

(22) Filed: Oct. 9, 2007

(51) Int. Cl.
*A47G 1/17* (2006.01)

(52) U.S. Cl. ..... 248/205.3; 211/75; 248/111; 248/309.1; 248/312; 248/312.1

(58) Field of Classification Search ..... 248/205.3, 248/309.1, 309.4, 312, 312.1, 314, 902, 110, 248/111; 211/75, 66
See application file for complete search history.

(56) References Cited

U.S. PATENT DOCUMENTS 2,028,694 A * 1/1936 Spinks ..... 211/65
2,506,333 A * 5/1950 Bedynek ..... 248/110
3,990,755 A * 11/1976 Krause ..... 312/207
4,605,292 A * 8/1986 McIntosh ..... 359/870
7,255,313 B2 8/2007 Lane
2005/0082456 A1 * 4/2005 Petri et al. ..... 248/312

* cited by examiner

*Primary Examiner*—Ramon O Ramirez
(74) *Attorney, Agent, or Firm*—Albert Bordas, P.A.

(57) ABSTRACT

A bracket assembly to suspend objects comprising a bracket and a cap assembly. The bracket has a mounting plate that comprises a front surface and a rear surface. The bracket also has a U-shaped bracket having first and second arms that perpendicularly extend from the front surface. The U-shaped bracket defines first and second interior side edges and an interior rear edge. The cap assembly works in combination with a container. The cap assembly comprises a cap head, a bottom edge, and a ring. The ring has a first outside diameter that is larger than a distance between said first and second interior side edges to suspend the cap assembly in combination with the container from the bracket.

5 Claims, 6 Drawing Sheets

BRACKET ASSEMBLY TO SUSPEND OBJECTS

BACKGROUND OF THE INVENTION

1. Field of the Invention

The present invention relates to brackets, and more particularly, to bracket assemblies to organize objects in a suspended manner.

2. Description of the Related Art

Applicant believes that the only reference corresponds to Applicant's own U.S. Pat. No. 7,255,313, issued on Aug. 14, 2007 for Bracket Assembly to Suspend Objects. However, it differs from the present invention because Lane's issued patent teaches a bracket assembly to suspend objects, having a bracket and a suspending tab assembly for organizing objects in a suspended manner. The bracket comprises a rear and front wall joined at a top edge and a bottom edge. An interior seam defines the interior area where the rear wall and the front wall join. The front wall comprises at least one aperture having a longitudinal channel defined by edges. The suspending tab assembly comprises a generally elongated torso having a first tab at its distal end. The first tab is shaped to snugly fit within the at least one aperture. Opposite the first tab, the torso has a second tab. The second tab has adhesive means. A peel-off sticker initially covers the second tab to prevent unwanted matter from sticking to the rear surface. The rear face of the rear wall also has adhesive means and also has a peel-off sticker.

SUMMARY OF THE INVENTION

The instant invention is a bracket assembly to suspend objects. It comprises a bracket that has a mounting plate. The mounting plate has a front surface and a rear surface. The bracket also comprises a U-shaped bracket having first and second arms that perpendicularly extend from the front surface. The U-shaped bracket defines first and second interior side edges and an interior rear edge. The U-shaped bracket also has distal ends with respective tabs that extending upwardly at a perpendicular disposition with respect to the U-shaped bracket. The rear surface has adhesive means and a removable cover thereon.

The instant invention also has a cap assembly in combination with a container. The cap assembly comprises a cap head, a bottom edge, and a ring. The ring has a first outside diameter that is larger than a distance between the first and second interior side edges. The cap assembly further comprises an exterior sidewall that extends vertically from the bottom edge to the ring. The exterior sidewall has a second outside diameter. The first outside diameter is larger than the second outside diameter and the distance between the first and second interior side edges. The second outside diameter is smaller than the distance between the first and second interior side edges.

The bracket mounts onto a wall with the adhesive means of the rear surface once the removable cover is removed from the rear surface and a force is placed upon the bracket and against the wall so that the rear surface adheres to it. The bracket suspends the cap assembly in combination with the container, whereby the ring rests upon the U-shaped bracket and is secured between the respective tabs, the interior rear edge, and the first and second interior side edges.

It is therefore one of the main objects of the present invention to provide a bracket assembly to suspend objects comprising a cap assembly having a ring with a cooperative shape and dimension to engage onto a U-shaped bracket for organizing objects in a suspended manner.

It is another object of the present invention to provide a bracket assembly to suspend a variety of containers having matter within.

It is another object of the present invention to provide a bracket assembly to suspend a variety of toiletry items.

It is another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
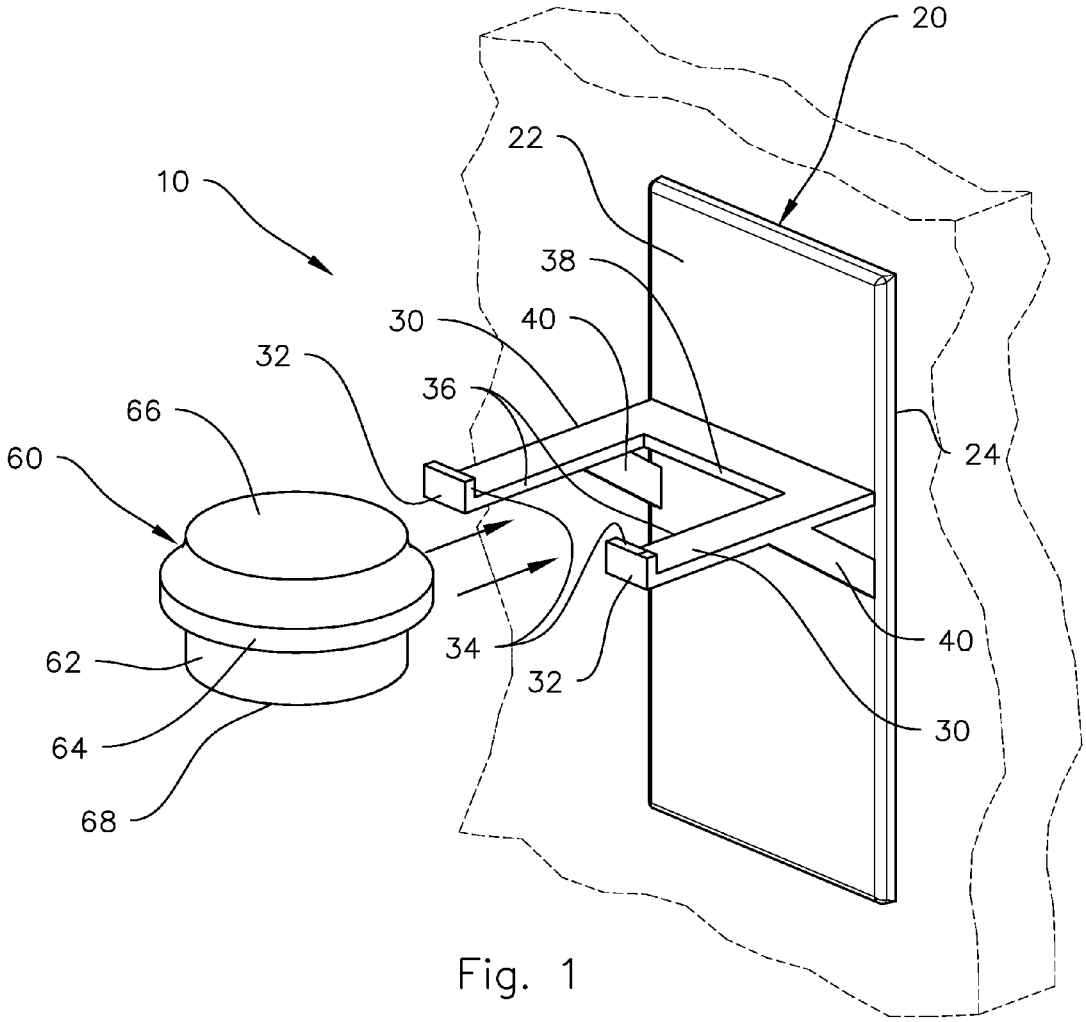
FIG. 1 represents an exploded view of the instant invention mounted onto a wall.

Referring now to the drawings, the bracket assembly to suspend objects is generally referred to with numeral 10. It can be observed that it basically includes bracket 20 and cap assembly 60.

As seen in FIG. 1, bracket 20 has a mounting plate that is substantially rectangular in shape and comprises front surface 22 and rear surface 24. U-shaped bracket 30 has arms that perpendicularly extend from front surface 22 and define interior side edges 36 and interior rear edge 38. U-shaped bracket 30 has distal ends 32 with tabs 34 extending upwardly at a perpendicular disposition with respect to U-shaped bracket 30. Support arms 40 extend at a predetermined angle from front surface 22 to U-shaped bracket 30.

Figure 2:
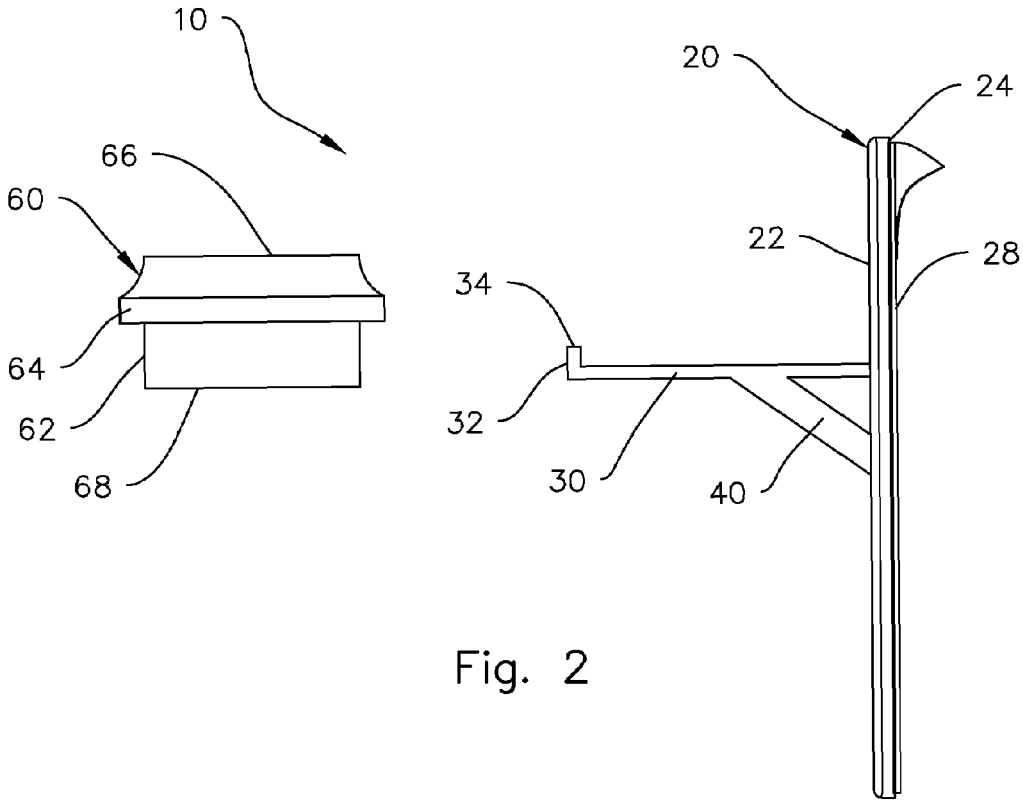
FIG. 2 is a side view of the instant invention, showing a partially removed removable cover, and the cap assembly in position to be mounted to the bracket.

As seen in FIG. 2, rear surface 24 has an adhesive means such as light glue and removable cover 28 prevents unwanted matter from sticking to rear surface 24. In use, bracket 20 is mounted onto wall W, seen in FIG. 3, with the adhesive means of rear surface 24 once a user removes removable cover 28 from rear surface 24 and applies a force upon bracket 20 against wall W, so that rear surface 24 can stick to wall W. Wall W may include, but is not limited to, a bathroom wall, a wall structure, furniture panels, kitchen cabinet doors, and/or other vertical surfaces having sufficient area for instant invention 10. Cap assembly 60 may have different configurations and shapes depending on the container it is used with.

Figure 3:
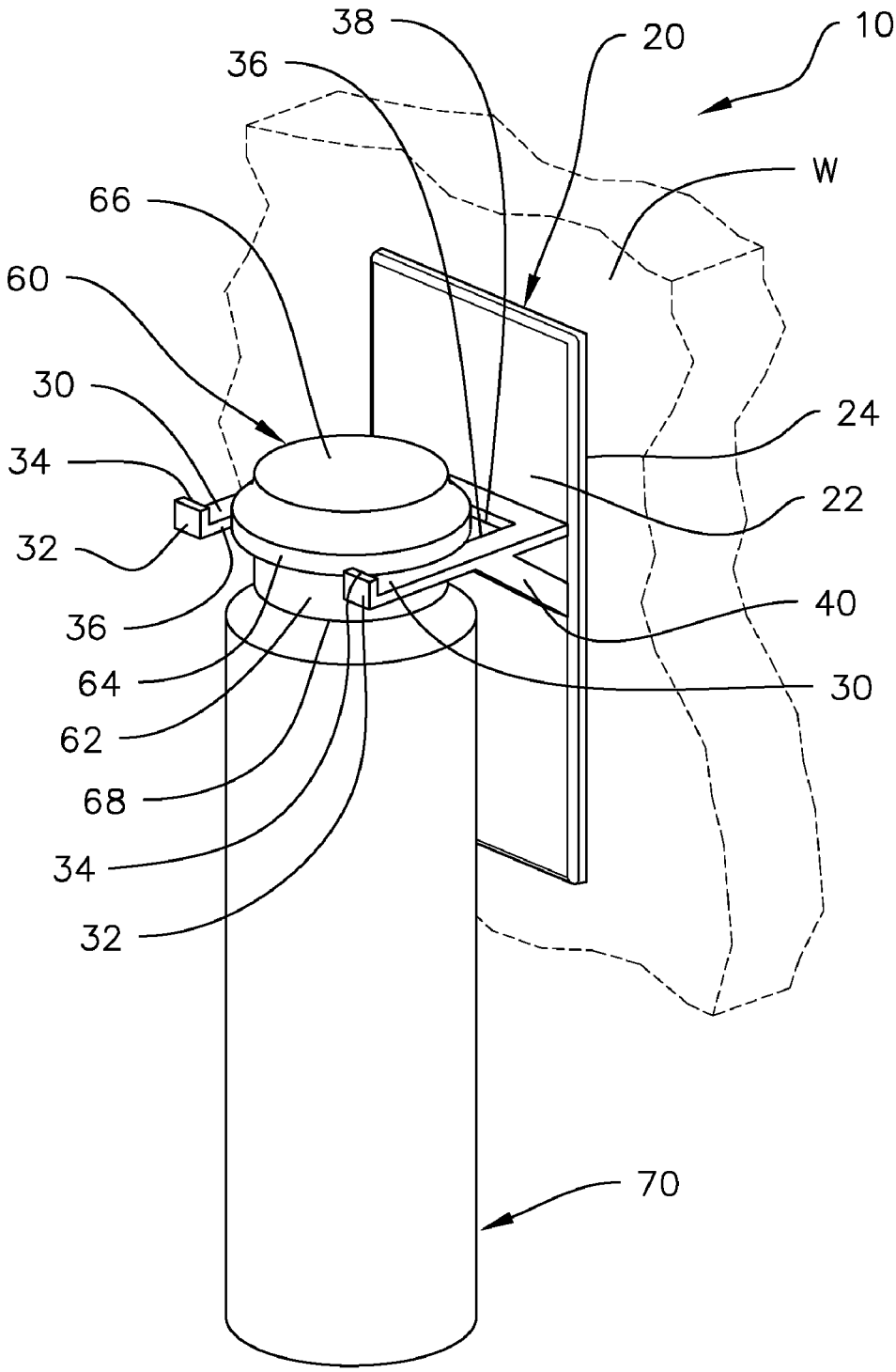
FIG. 3 is an isometric view of the instant invention mounted onto the wall while suspending a first container.
Figure 3A:
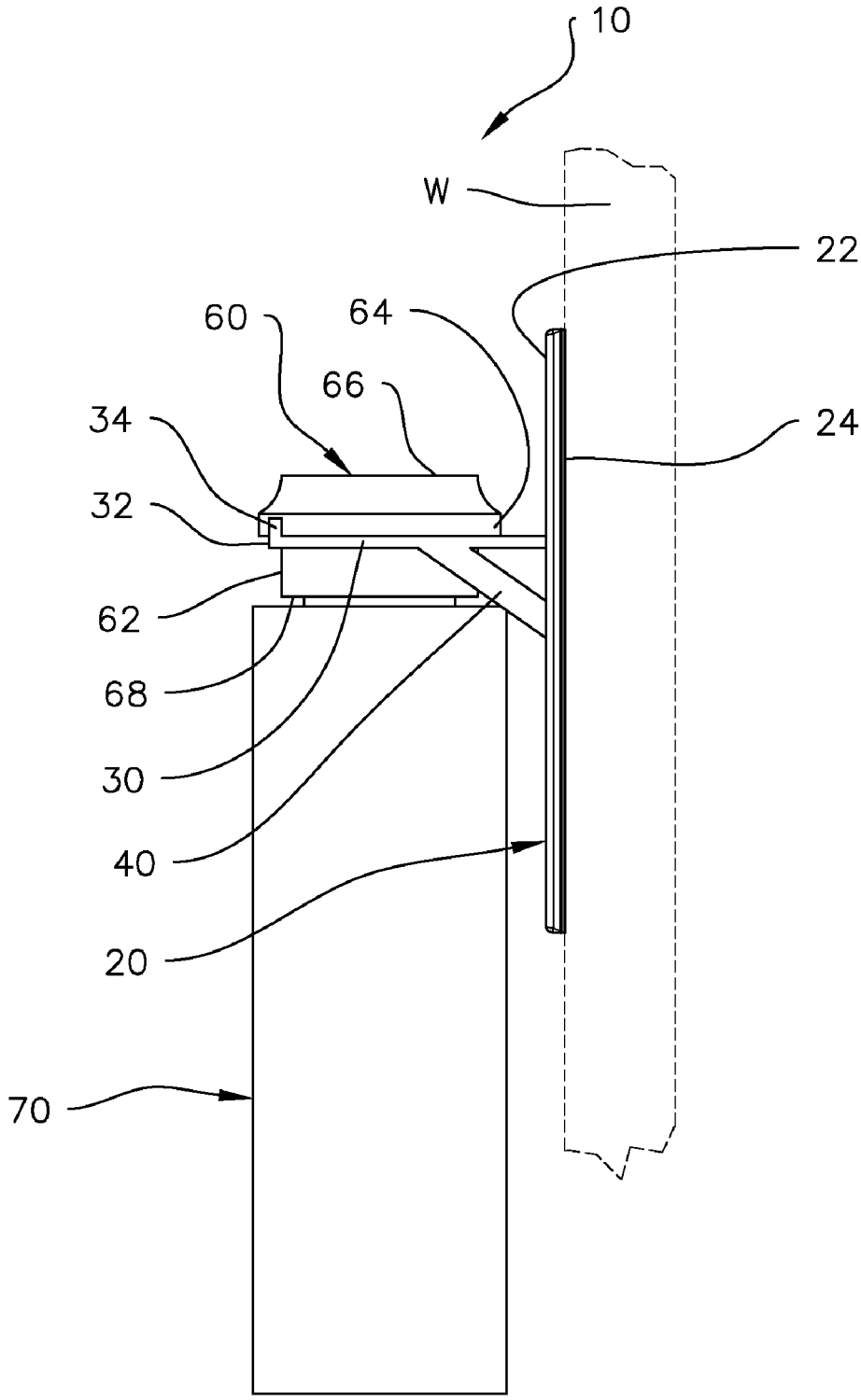
FIG. 3A is a side view of the instant invention mounted onto the wall while suspending the first container shown in FIG. 3.

As seen in FIGS. 3 and 3A, cap assembly 60 is used for container 70. Container 70 may store hair shampoo or hair conditioner as an example. Cap assembly 60 comprises cap head 66, and exterior sidewall 62 that extends vertically from bottom edge 68 to ring 64. Ring 64 has an outside diameter that is larger than the diameter defined by exterior sidewall 62, and is also larger than the distance between interior side edges 36. It is noted that a neck is defined as extending from cap head 66 to ring 64 at a predetermined curvature, as seen in FIGS. 3 and 3A. Furthermore, the diameter defined by exterior sidewall 62 is smaller than the distance between interior side edges 36.

For mounting cap assembly 60 with container 70 suspended therefrom and onto bracket 20, cap assembly 60 is placed onto U-shaped bracket 30 so that ring 64 rests upon shaped bracket 30 and secured between tabs 34, interior rear edge 38, and interior side edges 36 as illustrated in FIGS. 3 and 3A. It is noted that cap assembly 60 may screw, snap, or otherwise secure onto container 70.

It is noted that a plurality of instant inventions 10 may be mounted onto wall W in an effort to organize a plurality of containers 70 that are often used to store or house matter such as, but not limited to, hair shampoo and hair conditioner. Furthermore, once mounted onto wall W, a person using said containers 70 can easily locate a desired container and will not have to locate it on the floor of a shower as an example.

Figure 4A:
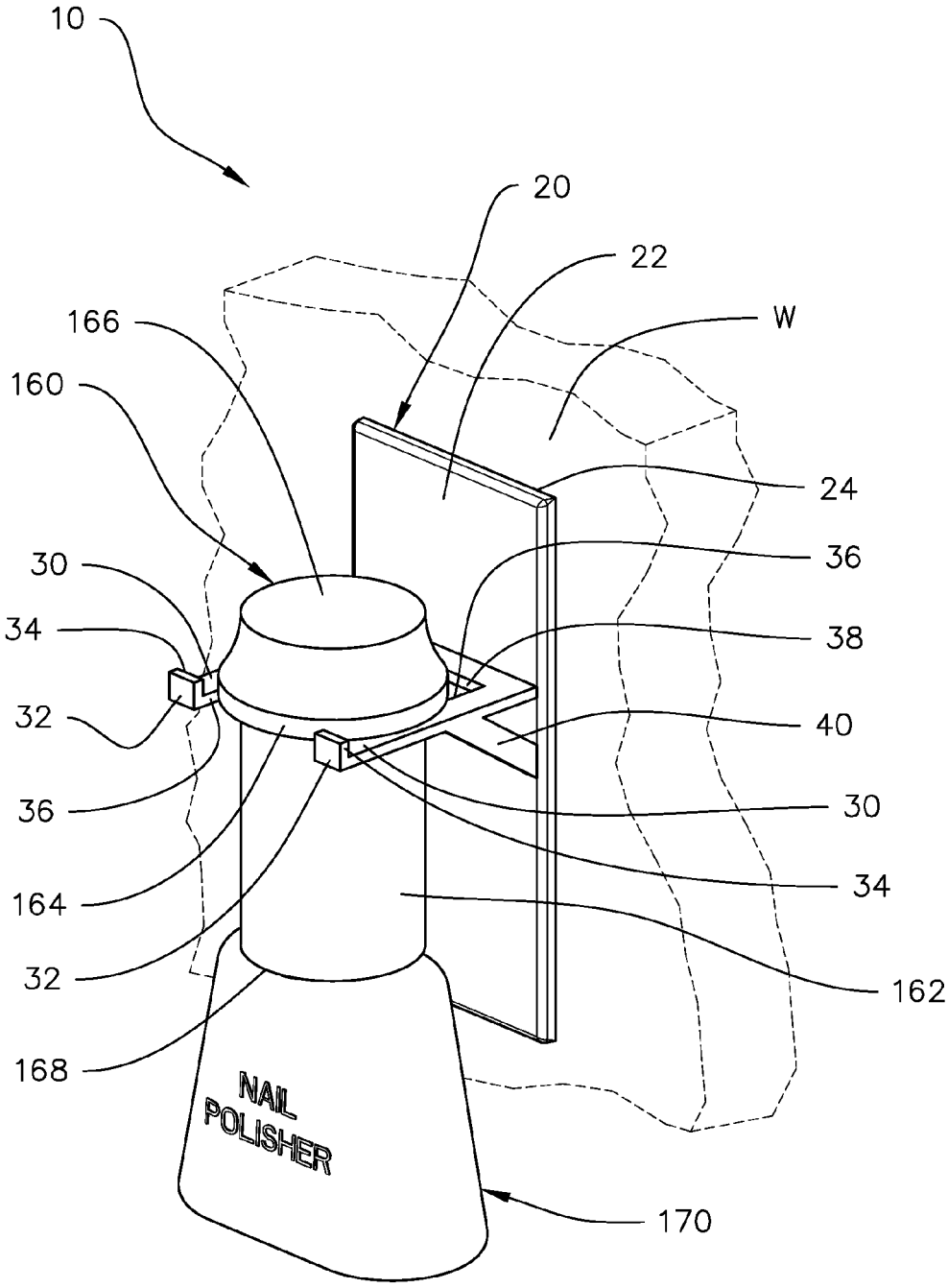
FIG. 4A is an isometric view of the instant invention mounted onto the wall while a first alternate cap assembly suspends a second container.

As seen in FIG. 4A, cap assembly 160 is used for container 170. Container 170 may store nail polish as an example. Cap assembly 160 comprises cap head 166, and exterior sidewall 162 that extends vertically from bottom edge 168 to ring 164. Ring 164 has an outside diameter that is larger than the diameter defined by exterior sidewall 162, and is also larger than the distance between interior side edges 36. It is noted that a neck is defined as extending from cap head 166 to ring 164 at a predetermined curvature, as seen in FIG. 4A. Furthermore, the diameter defined by exterior sidewall 162 is smaller than the distance between interior side edges 36.

For mounting cap assembly 160 with container 170 suspended therefrom and onto bracket 20, cap assembly 160 is placed onto U-shaped bracket 30 so that ring 164 rests upon shaped bracket 30 and secured between tabs 34, interior rear edge 38, and interior side edges 36 as illustrated in FIG. 4A. It is noted that cap assembly 160 may screw, snap, or otherwise secure onto container 170.

It is noted that a plurality of instant inventions 10 may be mounted onto wall W in an effort to organize a plurality of containers 170 that are often used to store or house matter such as, but not limited to, nail polish. Furthermore, once mounted onto wall W, a person using said containers 170 can easily locate a desired container and will not have to locate it on a table as an example.

Figure 4B:
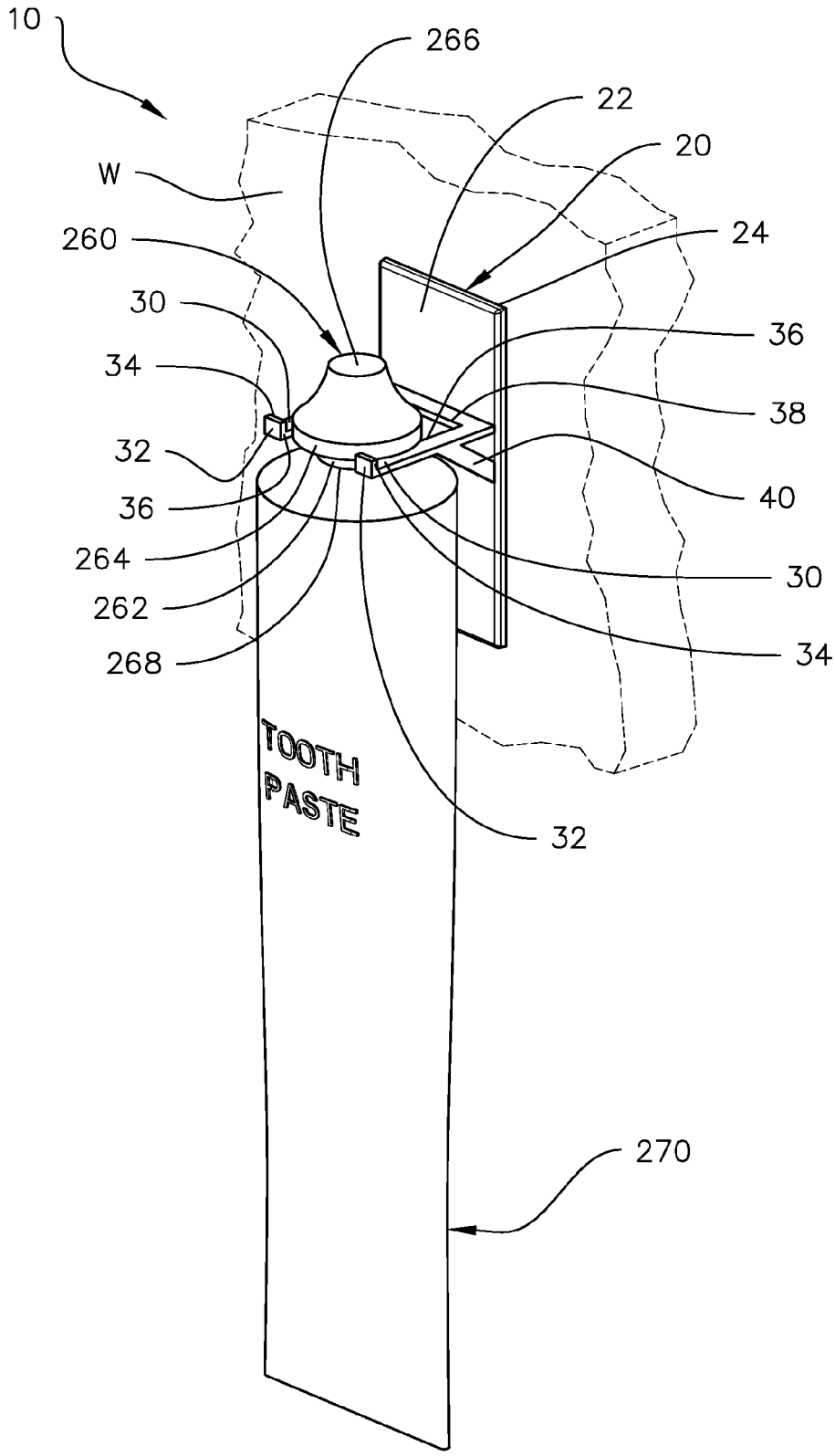
FIG. 4B is an isometric view of the instant invention mounted onto the wall while a second alternate cap assembly suspends a third container.

As seen in FIG. 4B, cap assembly 260 is used for container 270. Container 270 may store toothpaste as an example. Cap assembly 260 comprises cap head 266, and exterior sidewall 262 that extends vertically from bottom edge 268 to ring 264. Ring 264 has an outside diameter that is larger than the diameter defined by exterior sidewall 262, and is also larger than the distance between interior side edges 36. It is noted that a neck is defined as extending from cap head 266 to ring 264 at a predetermined curvature, as seen in FIG. 4B. Furthermore, the diameter defined by exterior sidewall 262 is smaller than the distance between interior side edges 36.

For mounting cap assembly 260 with container 270 suspended therefrom and onto bracket 20, cap assembly 260 is placed onto U-shaped bracket 30 so that ring 264 rests upon shaped bracket 30 and secured between tabs 34, interior rear edge 38, and interior side edges 36 as illustrated in FIG. 4B. It is noted that cap assembly 260 may screw, snap, or otherwise secure onto container 270.

It is noted that a plurality of instant inventions 10 may be mounted onto wall W in an effort to organize a plurality of containers 270 that are often used to store or house matter such as, but not limited to, toothpaste. Furthermore, once mounted onto wall W, a person using said containers 270 can easily locate a desired container and will not have to locate it on the floor of a shower as an example.

The angle and dimension of support arms 40 secure U-shaped bracket 30 in place when they are loaded with the above-referenced cap assemblies 60; 160; and 260 and their respective containers 70; 170; and 270 without structural interference. Furthermore, in the preferred embodiment, rings 64; 164; and 264 are permanently fixed upon their respective referenced cap assemblies 60; 160; and 260, but in an alternate embodiment, they may be removable from the cap assemblies. In addition, certain toiletry items may comprise rings 64; 164; and 264 mounted upon, near or adjacent to their respective handles. Such toiletry items include, but are not limited to, razors, toothbrushes, combs, and brushes.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bracket assembly to suspend objects comprising:

A) a bracket having a mounting plate with first and second ends and first and second lateral sides, said mounting plate also comprises a front surface and a rear surface, said bracket further comprising a U-shaped bracket having first and second arms that perpendicularly extend from said front surface, said first and second arms are parallel and extend from between said first and second ends, said U-shaped bracket define first and second interior side edges and an interior rear edge, said U-shaped bracket also has distal ends with respective tabs that extend upwardly at a perpendicular disposition with respect to said U-shaped bracket, said rear surface has adhesive means and a removable cover thereon, said bracket further comprises first and second support arms that extend at a predetermined angle from said front surface to said U-shaped bracket, said first and second support arms are parallel and extend from between said first and second arms and said second end; and B) a cap assembly in combination with a container, said cap assembly comprises a cap head, a bottom edge, and a ring, said ring has a first outside diameter that is larger than a distance between said first and second interior side edges, said cap assembly further comprises an exterior sidewall that extends vertically from said bottom edge to said ring, said exterior sidewall having a second outside diameter, said cap head is smaller in diameter than said first outside diameter, said cap assembly further comprising a neck, said neck extending from said cap head to said ring at a predetermined curvature.

2. The bracket assembly to suspend objects set forth in claim 1, further characterized in that said first outside diameter is larger than said second outside diameter and said distance between said first and second interior side edges.

3. The bracket assembly to suspend objects set forth in claim 2, further characterized in that said second outside diameter is smaller than said distance between said first and second interior side edges.

4. The bracket assembly to suspend objects set forth in claim 3, further characterized in that said bracket mounts onto a wall with said adhesive means of said rear surface once said removable cover is removed from said rear surface and a force is placed upon said bracket and against said wall so that said rear surface adheres to said wall.

5. The bracket assembly to suspend objects set forth in claim 4, further characterized in that said bracket suspends said cap assembly in combination with said container whereby said ring rests upon said U-shaped bracket and is secured between said respective tabs, said interior rear edge, and said first and second interior side edges.

* * * * *